US010714037B2

(12) United States Patent
Tomizawa

(10) Patent No.: US 10,714,037 B2
(45) Date of Patent: Jul. 14, 2020

(54) DISPLAY DEVICE

(71) Applicant: Japan Display Inc., Tokyo (JP)

(72) Inventor: Kazunari Tomizawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/356,420

(22) Filed: Mar. 18, 2019

(65) Prior Publication Data

US 2019/0295481 A1 Sep. 26, 2019

(30) Foreign Application Priority Data

Mar. 23, 2018 (JP) ..... 2018-056402

(51) Int. Cl.
*G09G 3/36* (2006.01)

(52) U.S. Cl.
CPC ... *G09G 3/3607* (2013.01); *G09G 2300/0452* (2013.01)

(58) Field of Classification Search
CPC ..... G09G 3/3607; G09G 2300/0452; G09G 2340/06; G09G 2320/0666; G09G 5/10; G09G 3/2003
See application file for complete search history.

(56) References Cited

U.S. PATENT DOCUMENTS 7,277,075 B1 * 10/2007 Hirano ..... G09G 5/02 345/89
2005/0140614 A1 * 6/2005 Baek ..... G09G 5/02 345/87
2007/0159492 A1 * 7/2007 Lo ..... G09G 5/026 345/589
2007/0257943 A1 * 11/2007 Miller ..... G09G 3/3225 345/694
2007/0257945 A1 * 11/2007 Miller ..... G09G 3/2003 345/694
2012/0287147 A1 * 11/2012 Brown Elliott ..... G09G 3/3426 345/593
2013/0241810 A1 * 9/2013 Higashi ..... G09G 3/3406 345/77
2017/0053624 A1 * 2/2017 Hayashi ..... G09G 5/026
2018/0061368 A1 * 3/2018 Sako ..... G09G 3/3611

FOREIGN PATENT DOCUMENTS

JP 2015-197461 A 11/2015

* cited by examiner

*Primary Examiner* — Carolyn R Edwards
(74) *Attorney, Agent, or Firm* — K&L Gates LLP

(57) ABSTRACT

A display device includes: a display unit including sub-pixels; and a signal processor. The sub-pixels are arranged such that either a first sub-pixel or a third sub-pixel is between a second sub-pixel and a fourth sub-pixel arranged in one direction. The signal processor outputs output signals to assign, to a set of the sub-pixels included in the display unit, color components assigned to two pieces of pixel data arranged in the one direction in input signals. The set of the sub-pixels is made up of the first, second, third, and fourth sub-pixels. The signal processor assigns a first color component that is a part or the whole of a white component in one of the two pieces of the pixel data to the fourth sub-pixel and second color components other than the first color component in the two pieces of the pixel data to the first to third sub-pixels.

6 Claims, 14 Drawing Sheets

DISPLAY DEVICE

CROSS-REFERENCE TO RELATED APPLICATIONS

This application claims priority from Japanese Application No. 2018-056402, filed on Mar. 23, 2018, the contents of which are incorporated by reference herein in its entirety.

BACKGROUND

1. Technical Field

The present disclosure relates to a display device.

2. Description of the Related Art

Methods are known (for example, in Japanese Patent Application Laid-open Publication No. 2015-197461) in which image data with a predetermined resolution composed of a predetermined number of pixels is displayed with pixels the number of which is smaller than the predetermined number.

There is a need for a display device capable of displaying image data with a predetermined resolution composed of a predetermined number of pieces of pixel data, with a smaller number of sub-pixels.

SUMMARY

According to an aspect, a display device includes: a display unit in which a plurality of sub-pixels are arranged in a matrix along row and column directions; and a signal processor configured to output output signals for causing the display unit to display an image based on input signals for the image in which pixel data including three colors of red, green, and blue is arranged in a matrix. The sub-pixels include a first sub-pixel for red, a second sub-pixel for green, a third sub-pixel for blue, and a fourth sub-pixel for white. Either the first sub-pixel or the third sub-pixel is interposed between the second sub-pixel and the fourth sub-pixel arranged in one direction of the row direction and the column direction. The signal processor is configured to output the output signals to assign, to a set of the sub-pixels included in the display unit, color components assigned to two pieces of the pixel data arranged in the one direction in the input signals. The set of the sub-pixels is made up of the first sub-pixel, the second sub-pixel, the third sub-pixel, and the fourth sub-pixel. The signal processor is configured to assign a first color component to the fourth sub-pixel and second color components to the first sub-pixel, the second sub-pixel, and the third sub-pixel, the first color component being a part or the whole of a white component included in one piece of the pixel data among the color components included in the two pieces of the pixel data, the second color components being components other than the first color component of the color components included in the two pieces of the pixel data.

DETAILED DESCRIPTION

Figure 1:
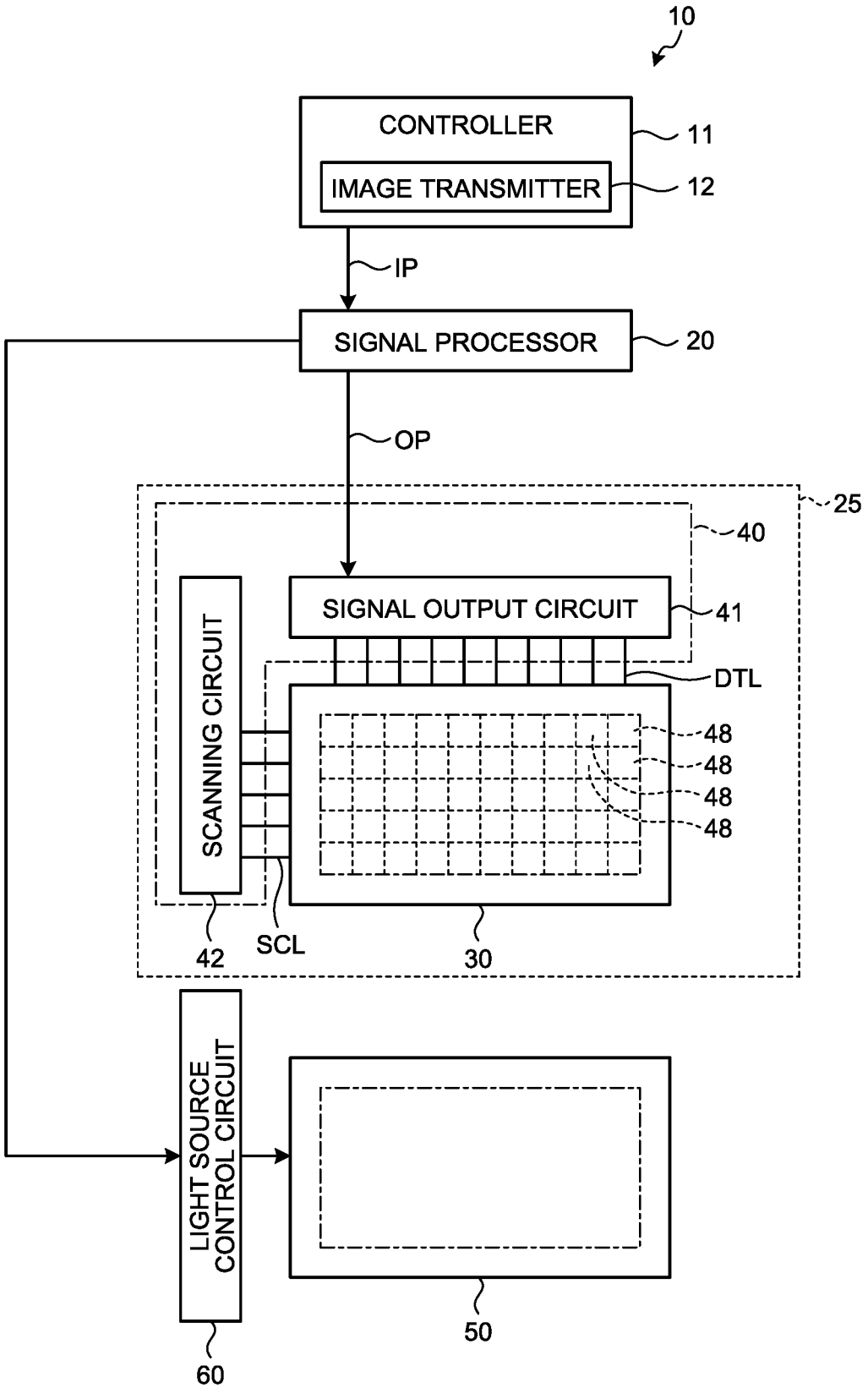
FIG. 1 is a block diagram illustrating an exemplary configuration of a display device according to a first embodiment.

The following describes embodiments of the present invention with reference to the drawings. The disclosure is merely an example, and the present invention naturally encompasses appropriate modifications easily conceivable by those skilled in the art while maintaining the gist of the invention. To further clarify the description, widths, thicknesses, shapes, and the like of various parts are schematically illustrated in the drawings as compared with actual aspects thereof, in some cases. However, they are merely examples, and interpretation of the present invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

First Embodiment

Figure 2:
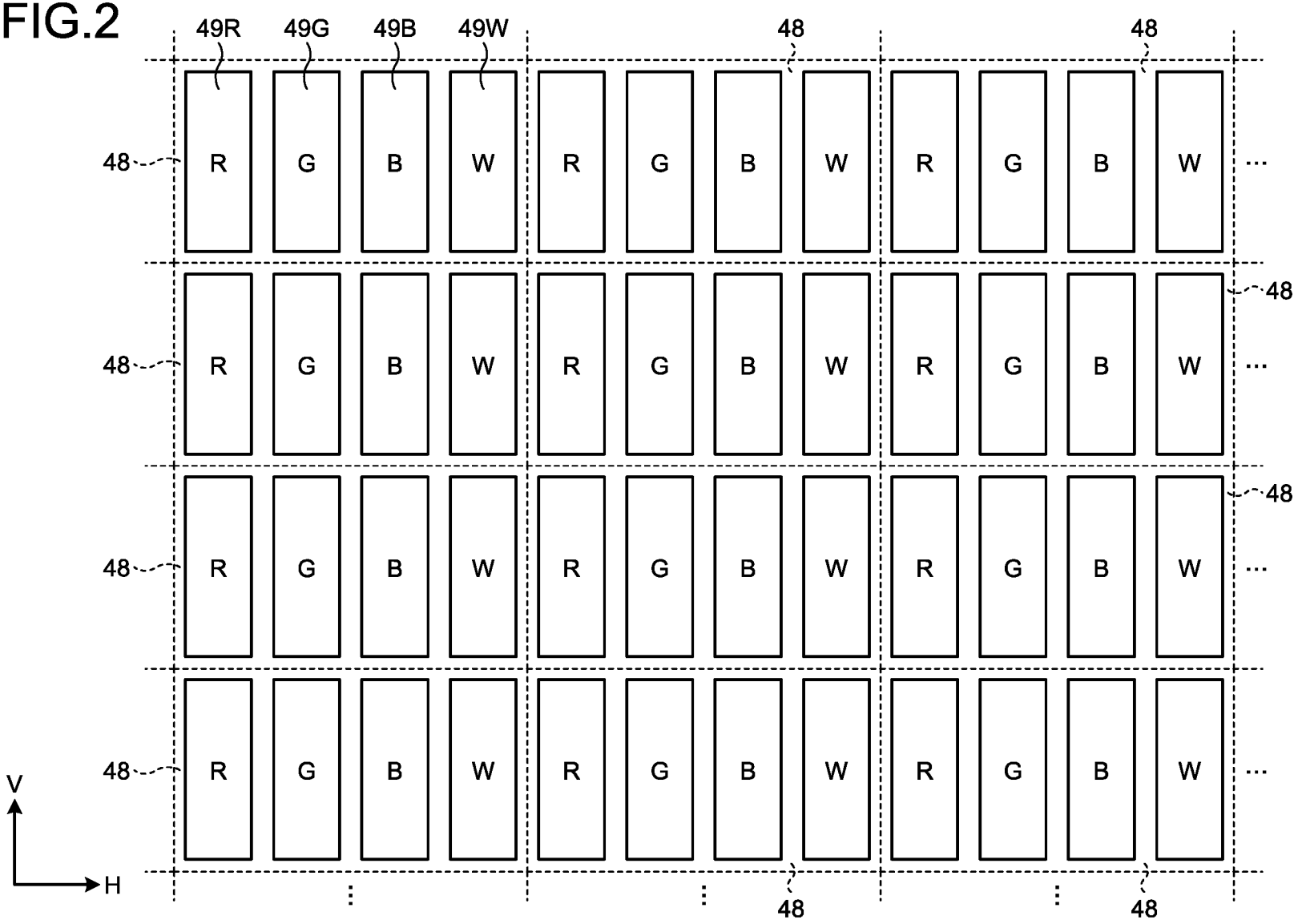
FIG. 2 is a schematic diagram illustrating an array of pixels and sub-pixels of an image display panel according to the first embodiment.
Figure 3:
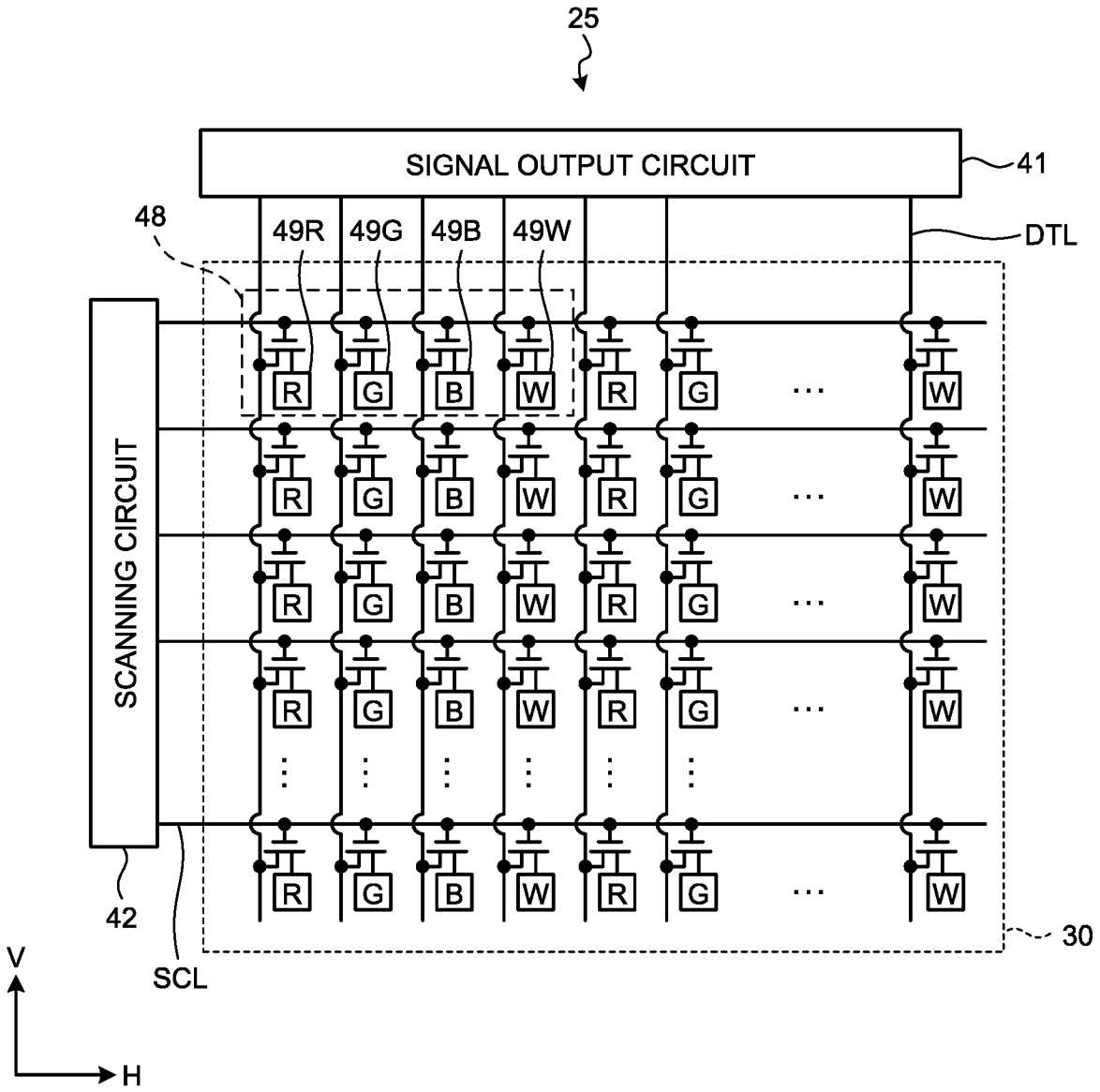
FIG. 3 is a conceptual diagram of the image display panel and an image display panel drive circuit of the display device according to the first embodiment.

FIG. 1 is a block diagram illustrating an exemplary configuration of a display device 10 according to a first embodiment of the present invention. FIG. 2 is a schematic diagram illustrating an array of pixels 48 and sub-pixels 49 of an image display panel according to the first embodiment. FIG. 3 is a conceptual diagram of the image display panel and an image display panel drive circuit of the display device 10 according to the first embodiment.

As illustrated in FIG. 1, the display device 10 includes a signal processor 20, an image display panel 30, an image display panel drive circuit 40, a planar light source device 50, and a light source control circuit 60. The signal processor 20 receives input signals IP (RGB data) from an image transmitter 12 of a controller 11 and performs prescribed data conversion processing to output output signals OP. The image display panel 30 displays an image based on the output signals OP output from the signal processor 20. The image display panel drive circuit 40 controls driving of the image display panel 30. The planar light source device 50 illuminates the image display panel 30, for example, from the back side thereof. The light source control circuit 60 controls driving of the planar light source device 50. In the embodiment, a component including the image display panel 30 and the image display panel drive circuit 40 serves as a display unit 25.

The signal processor 20 synchronously controls operations of the image display panel 30 and the planar light source device 50. The signal processor 20 is coupled to the image display panel drive circuit 40 for driving the image display panel 30 and to the light source control circuit 60 for driving the planar light source device 50. The signal processor 20 processes the externally received input signals IP to generate the output signals OP and a light source control signal. More specifically, the signal processor 20 converts input values (input signals IP) in an input HSV color space of the input signals IP representing color components of three colors of R, G, and B into reproduced values (output signals OP) in an extended HSV color space reproduced by color components of four colors of R, G, B, and W, and outputs the output signals OP based on the thus converted values to the image display panel drive circuit 40. The signal processor 20 outputs the light source control signal corresponding to the output signals OP to the light source control circuit 60.

Figure 4:
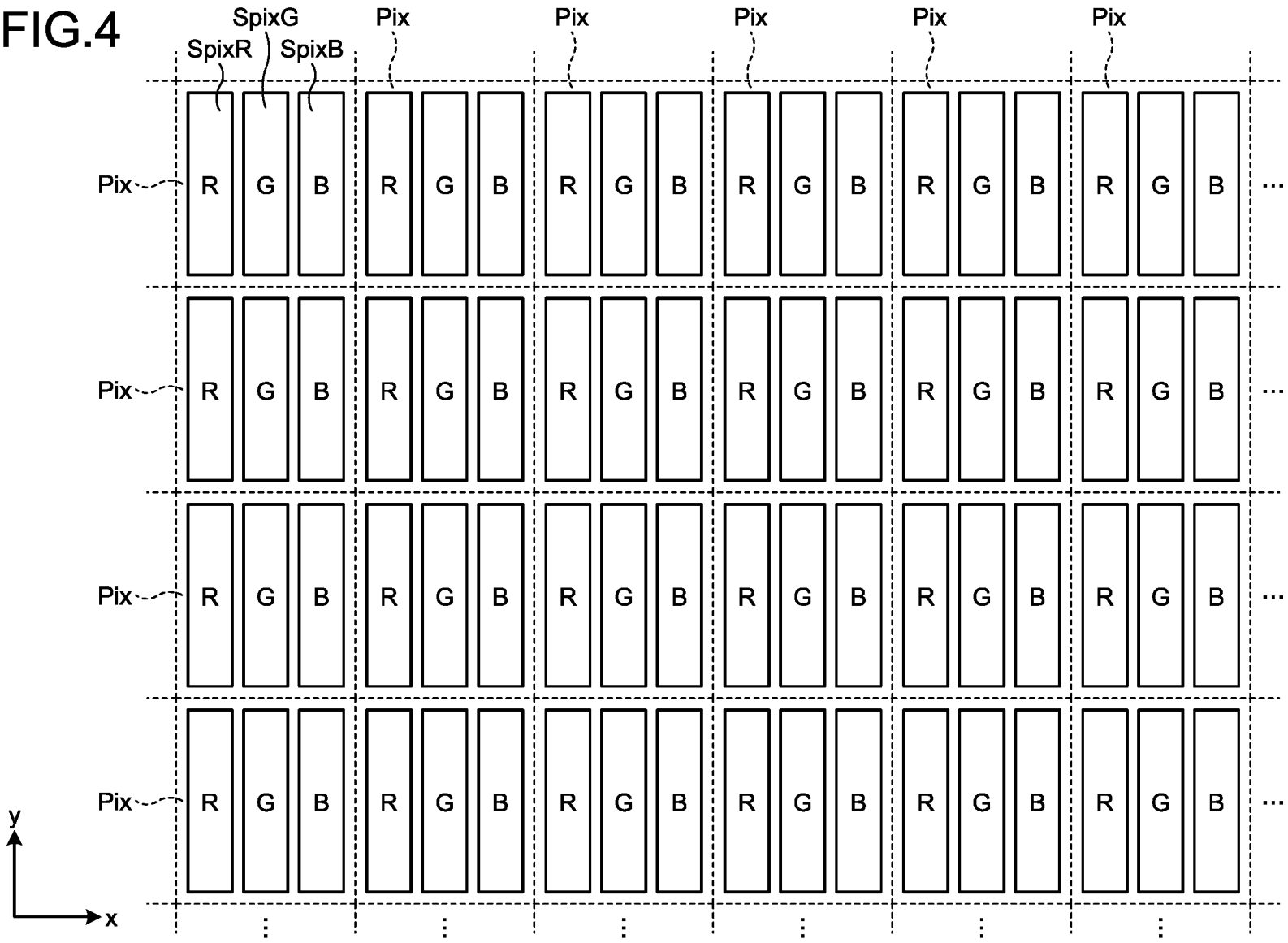
FIG. 4 is a schematic diagram of image data based on input signals.

FIG. 4 is a schematic diagram of image data based on the input signals IP. The image transmitter 12 outputs, as the input signals IP, signals constituting the image data in which pixel data Pix obtained by combining the three colors of R, G, and B is arranged in a matrix (row-column configuration), as illustrated in FIG. 4. The pixel data Pix corresponds to pixels in the input signals. In, for example, FIG. 4, of pieces of sub-pixel data of three colors constituting the pixel data Pix, red sub-pixel data is denoted by SpixR, green sub-pixel data is denoted by SpixG, and blue sub-pixel data is denoted by SpixB.

As illustrated in FIGS. 2 and 3, the pixels 48 are arranged in a matrix (row-column configuration) in a two-dimensional coordinate system of a Horizontal (H) axis and a Vertical (V) axis on the image display panel 30. In this example, the row direction corresponds to the H-direction, and the column direction corresponds to the V-direction. For the purpose of distinction between the array of the pixels 48 and the array of the pixel data Pix, the row direction and the column direction in the array of the pixels 48 are denoted by the H-direction and the V-direction, and the row direction and the column direction in the array of the pixel data Pix are denoted by an x-direction and a y-direction.

Each of the pixels 48 includes a first sub-pixel 49R, a second sub-pixel 49G, a third sub-pixel 49B, and a fourth sub-pixel 49W. The first sub-pixel 49R emits light in red (R). The second sub-pixel 49G emits light in green (G). The third sub-pixel 49B emits light in blue (B). The fourth sub-pixel 49W emits light in white (W). Hereinafter, the first sub-pixel 49R, the second sub-pixel 49G, the third sub-pixel 49B, and the fourth sub-pixel 49W will each be referred to as a sub-pixel 49 when they need not be distinguished from one another. In other words, the pixel 48 is one form of a set of sub-pixels including one first sub-pixel 49R, one second sub-pixel 49G, one third sub-pixel 49B, and one fourth sub-pixel 49W. The chromaticity of white (W) displayed by the fourth sub-pixel 49W is substantially equal to the chromaticity of white reproduced by uniform lighting of the three color sub-pixels 49 of the first, second, and third sub-pixels 49R, 49G, and 49B.

The display device 10 is, for example, a transmissive color liquid crystal display device. In this example, the image display panel 30 is a color liquid crystal display panel, on which a first color filter for transmitting light in red (R) is provided between the first sub-pixel 49R and an image viewer; a second color filter for transmitting light in green (G) is provided between the second sub-pixel 49G and the image viewer; and a third color filter for transmitting light in blue (B) is provided between the third sub-pixel 49B and the image viewer. No color filter is provided between the fourth sub-pixel 49W on the image display panel 30 and the image viewer. A transparent resin layer, instead of a color filter, may be provided on the fourth sub-pixel 49W. In this way, when the transparent resin layer is provided, the image display panel 30 can restrain a large step from being formed on the fourth sub-pixel 49W by not providing the color filter on the fourth sub-pixel 49W.

In the example illustrated in FIG. 2, the sub-pixels 49 are arranged continually in the order of the first sub-pixel 49R, the second sub-pixel 49G, the third sub-pixel 49B, and the fourth sub-pixel 49W from one side toward the other side in the H-direction on the image display panel 30. In other words, the first sub-pixel 49R or the third sub-pixel 49B is present between the second sub-pixel 49G and the fourth sub-pixel 49W arranged in one direction (for example, the H-direction). In the example illustrated in FIG. 2, what is called a stripe array is formed in which the sub-pixels 49 having the same color are arranged in the other direction (for example, the V-direction). In general, arrays similar to the stripe array are suitable for displaying data or character strings on a personal computer and others.

The image display panel drive circuit 40 includes a signal output circuit 41 and a scanning circuit 42. The image display panel drive circuit 40 holds video signals in the signal output circuit 41, and sequentially outputs them to the image display panel 30. The signal output circuit 41 is electrically coupled to the image display panel 30 through wiring DTL. The image display panel drive circuit 40 uses the scanning circuit 42 to control on and off operation of a switching element (such as a thin-film transistor (TFT)) for controlling operation (such as display luminance, that is, light transmittance in this case) of the sub-pixel on the image display panel 30. The scanning circuit 42 is electrically coupled to the image display panel 30 through wiring SCL. In the display unit 25, to drive the sub-pixels 49, the scanning circuit 42 performs scanning in the other direction (for example, the V-direction) of the row and column directions, that is, along a direction of arrangement of the wiring SCL.

The planar light source device 50 is provided on the back side of the image display panel 30 and emits light toward the image display panel 30 to illuminate the image display panel 30. The planar light source device 50 emits the light to the entire surface of the image display panel 30 to illuminate the image display panel 30. The planar light source device 50 may have a front light configuration of being provided on the front side of the image display panel 30. Alternatively, a light-emitting display (such as an organic light emitting diode (OLED) display) can be used as the image display panel 30. In this case, the planar light source device 50 can be made unnecessary.

The light source control circuit 60 controls, for example, the irradiation light quantity of light emitted from the planar light source device 50. Specifically, the light source control circuit 60 adjusts the duty cycle of a signal, a current, or a voltage supplied to the planar light source device 50 based on the light source control signal that is output from the signal processor 20, thereby controlling the irradiation light quantity (light intensity) of the light with which the image display panel 30 is irradiated.

The following describes signal processing by the signal processor 20. The signal processor 20 outputs the output signals OP to the image display panel drive circuit 40 of the display unit 25. The output signal OP assigns, to one pixel 48 included in the image display panel 30, color components assigned to two pieces of pixel data Pix arranged in one direction (for example, the x-direction) of the row and column directions in the input signals IP. Specifically, the image display panel 30 assigns a first color component to the fourth sub-pixel 49W included in the one pixel 48 and assigns second color components to the first, second, and third sub-pixels 49R, 49G, and 49B therein. The first color component is a part or the whole of a white component included in one piece of the pixel data Pix among the color components included in the two pieces of the pixel data Pix. The second color components are components other than the first color component of the color components included in the two pieces of the pixel data Pix.

The term "white component" refers to, among the color components, color components convertible to white. The term "color components convertible to white" refers to a combination of components obtained by evenly extracting color components corresponding to the lowest gradation value of gradation values (R, G, B) of red (R), green (G), and blue (B) in the input signals IP from the three colors. For example, when (R, G, B)=(100, 150, 50), the lowest gradation value is the gradation value 50 of blue (B). In this case, the white component is given as (R, G, B)=(50, 50, 50).

Figure 5:
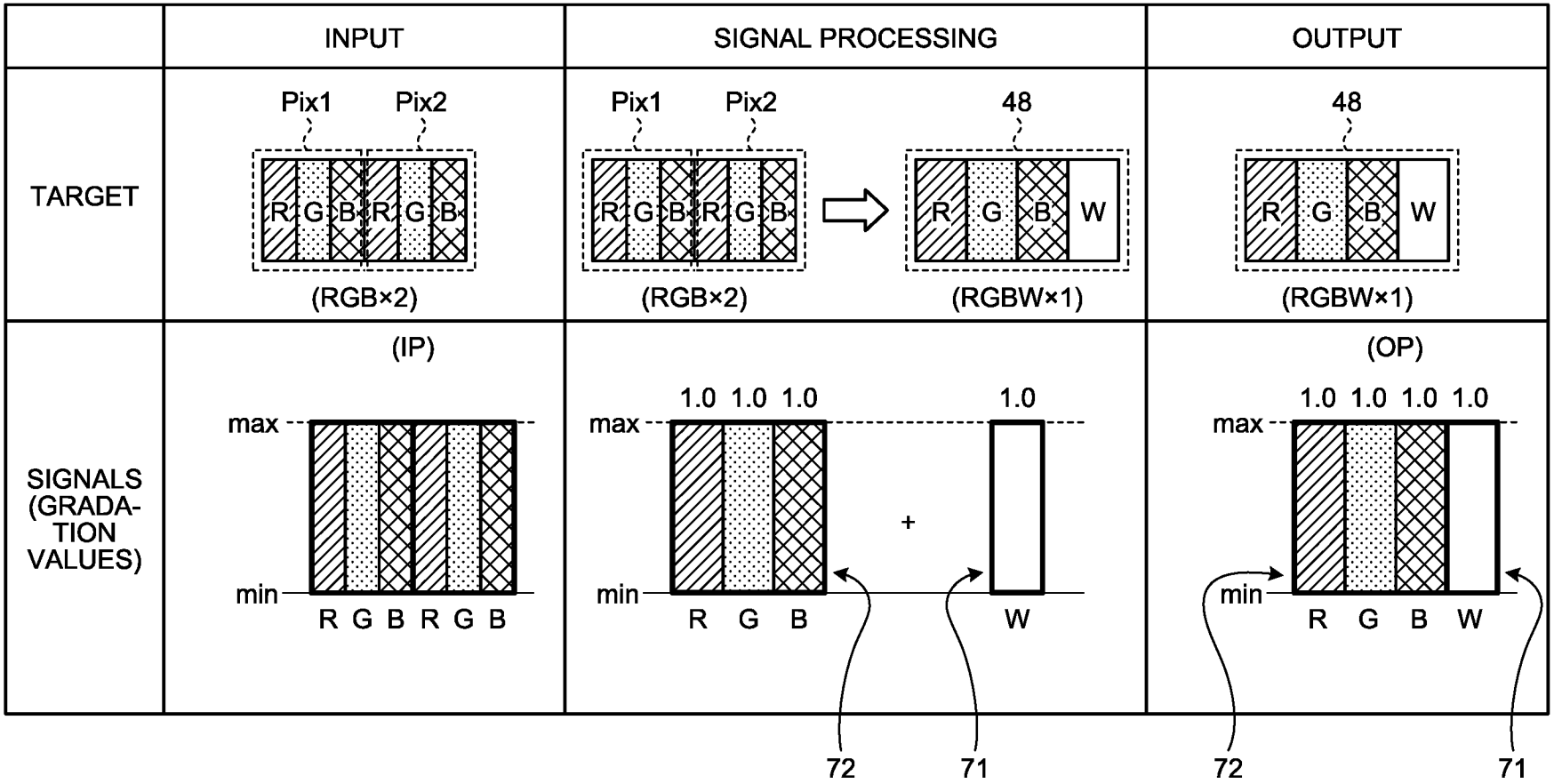
FIG. 5 is an explanatory diagram illustrating an example of signal processing by a signal processor.
Figure 6:
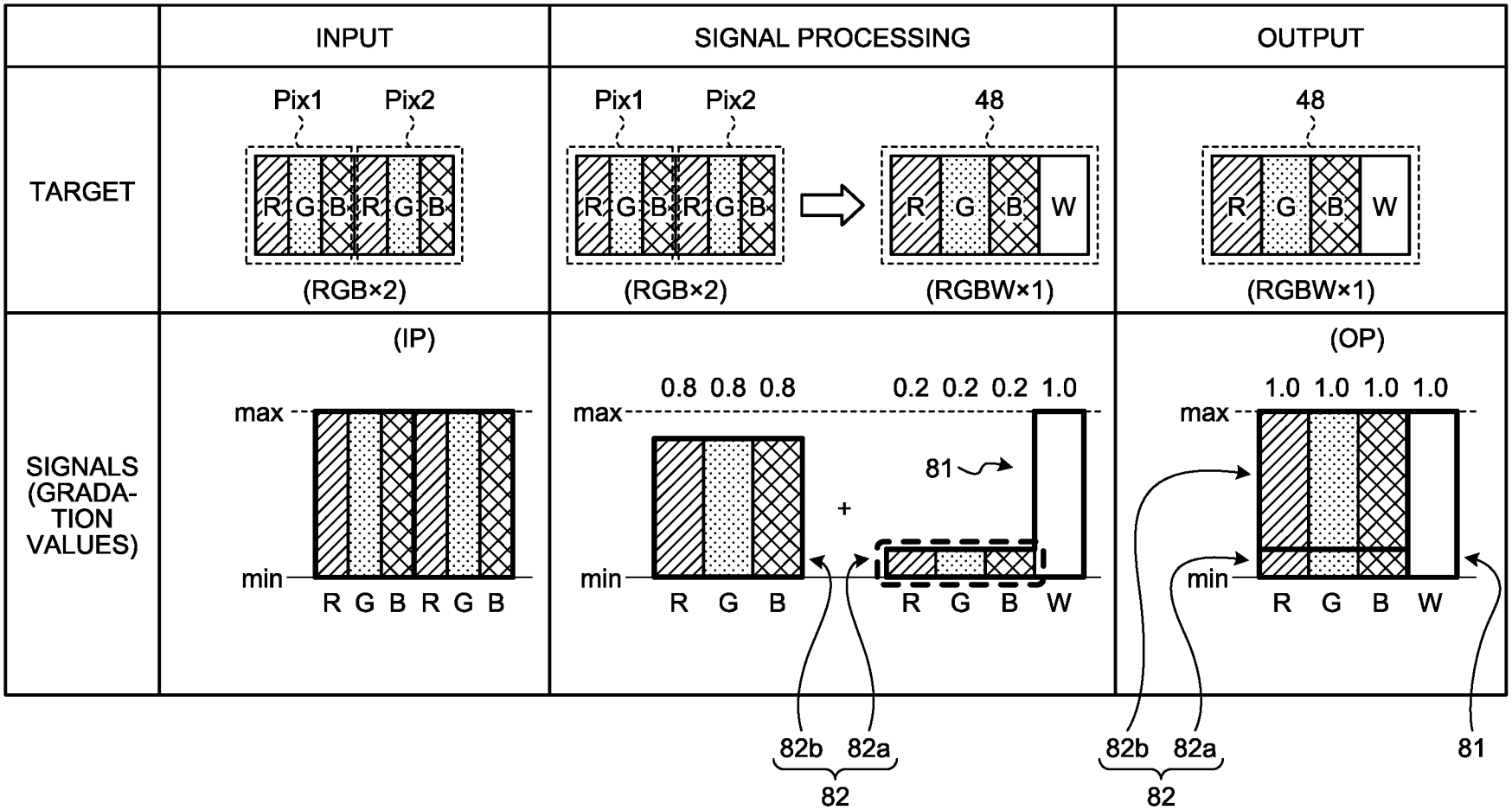
FIG. 6 is an explanatory diagram illustrating another example of the signal processing by the signal processor.

FIGS. 5 and 6 are explanatory diagrams illustrating examples of the signal processing by the signal processor 20. With reference to FIGS. 5 and 6, the following describes the signal processing performed by the signal processor 20 to generate the output signal OP that assigns the color components of two pieces of pixel data Pix1 and Pix2 included in the input signals IP to one pixel 48.

The input signals IP illustrated in FIGS. 5 and 6 indicate that both the two pieces of pixel data Pix1 and Pix2 represent (R, G, B)=(max, max, max), that is, both the two pieces of pixel data Pix1 and Pix2 represent white at the highest luminance. The symbol max represents the maximum value of each of the gradation values of red (R), green (G), and blue (B) in the input signals. For example, if each of red (R), green (G), and blue (B) is expressed as an 8-bit value, max=255. In other words, in this case, (R, G, B)=(255, 255, 255).

The signal processor 20 generates the output signals OP based on the input signals IP. Specifically, in the case of the example illustrated in FIG. 5, the signal processor 20 assigns, to the fourth sub-pixel 49W, the white color component of the color components represented by one (for example, the pixel data Pix2) of the two pieces of pixel data Pix1 and Pix2 as a first color component 71. The signal processor 20 assigns, to the first, second, and third sub-pixels 49R, 49G, and 49B, color components represented by the other (for example, the pixel data Pix1) of the two pieces of pixel data Pix1 and Pix2 as second color components 72.

In the embodiment, the first color component 71 is the white component included in one of the two pieces of the pixel data Pix adjacent in one direction (for example, the x-direction) in the input signals IP, the one of the two pieces of the pixel data Pix corresponding to a relative position of the fourth sub-pixel 49W in one pixel 48. For example, the fourth sub-pixel 49W in the embodiment is located on the right side in FIG. 5 and other figures. Accordingly, of the two pieces of pixel data Pix, the pixel data Pix2 located on the right side serves as the one of the pieces of pixel data Pix corresponding to the relative position of the fourth sub-pixel 49W. In this way, the arrangement of one of the two adjacent pieces of the pixel data Pix in the input signals that serves as a basis for the first color component 71 corresponds to the arrangement of the fourth sub-pixel 49W included in one pixel 48 serving as a target of the output signal corresponding to the input signals. Accordingly, in the example illustrated in FIG. 5, a pixel including the white component handled as the first color component 71 corresponds to the pixel data Pix2. The same applies to the arrangement of one piece of the pixel data Pix serving as the basis for a first color component 81 and the arrangement of the fourth sub-pixel 49W included in one pixel 48 serving as the target of the output signal corresponding to the input signals, in FIG. 6 to be explained later.

The signal processor 20 assigns the white component of the pixel data Pix1 to the first, second, and third sub-pixels 49R, 49G, and 49B, and assigns the white component of the pixel data Pix2 to the fourth (W) sub-pixel. The signal processor 20 assigns color components other than the white component of the pixel data Pix1 and Pix2 to the first, second, and third sub-pixels 49R, 49G, and 49B. In FIG. 5, the ratio between the luminance of white obtained by the first color component 71 and the luminance of white obtained by the second color components 72 is 1:1. That is, the luminance of white reproduced by combination of the first, second, and third sub-pixels 49R, 49G, and 49B is equal to the luminance of white reproduced by the fourth sub-pixel 49W. In other words, the fourth sub-pixel 49W is provided so as to be capable of outputting the same luminance as that of white reproduced by the combination of the first, second, and third sub-pixels 49R, 49G, and 49B when the entire white color component of the color components represented by one (for example, the pixel data Pix2) of the two pieces of pixel data Pix1 and Pix2 is assigned as the first color component 71 to the fourth sub-pixel 49W. That is to say, in the example illustrated in FIG. 5, the pixel 48 is provided so as to be capable of reproducing white corresponding to (R, G, B)=(max, max, max) using either the combination of the first, second, and third sub-pixels 49R, 49G, and 49B or the fourth sub-pixel 49W.

In the case of the example illustrated in FIG. 6, the signal processor 20 assigns, to the fourth sub-pixel 49W, a part of the white color component of the color components represented by one (for example, the pixel data Pix2) of the two adjacent pieces of pixel data Pix1 and Pix2 as the first color component 81. The signal processor 20 assigns, to the first, second, and third sub-pixels 49R, 49G, and 49B, components (remaining components 82*a*) other than the part of the color components represented by the one (for example, the pixel data Pix2) of the two pieces of pixel data Pix1 and Pix2 and color components 82*b* represented by the other (for example, the pixel data Pix1) of the two pieces of pixel data Pix1 and Pix2 as second color components 82.

Specifically, the signal processor 20 assigns the white component of the pixel data Pix1 to the first, second, and third sub-pixels 49R, 49G, and 49B, and assigns the white component of the pixel data Pix2 to the fourth (W) sub-pixel. The signal processor 20 assigns color components other than the white components of the pixel data Pix1 and Pix2 to the first, second, and third sub-pixels 49R, 49G, and 49B. If the luminance of the white component of the pixel data Pix2 is higher than luminance displayable by the fourth sub-pixel 49W, the luminance can be supplemented by assigning the white component of the pixel data Pix2 to the first, second, and third sub-pixels 49R, 49G, and 49B. In FIG. 6, the ratio between the luminance of white obtained by the first color component 81 and the luminance of white obtained by the second color components 82 is not 1:1. Specifically, in the case of the example illustrated in FIG. 6, the combination of the first, second, and third sub-pixels 49R, 49G, and 49B can reproduce white corresponding to (R, G, B)=(max, max, max) of the pixel data Pix1 at luminance lower than the highest luminance of the first, second, and third sub-pixels 49R, 49G, and 49B (at luminance of 0.8 that is lower than max in FIG. 6). In contrast, the fourth sub-pixel 49W cannot reproduce white corresponding to (R, G, B)=(max, max, max) of the pixel data Pix2 even at the output of the highest luminance (max=1.0). In other words, the white component of the pixel data Pix (for example, the pixel data Pix2) in the input data corresponding to the fourth sub-pixel 49W represents higher luminance than the luminance of white reproducible by the fourth sub-pixel 49W. To reproduce white corresponding to (R, G, B)=(max, max, max) of the pixel data Pix2, the luminance of light output from the first, second, and third sub-pixels 49R, 49G, and 49B (for example, at 0.2) is required in addition to the highest luminance (max=1.0) reproducible by the fourth sub-pixel 49W.

In other words, in the example illustrated in FIG. 6, the luminance obtained by adding the output (for example, 0.2) of the first, second, and third sub-pixels 49R, 49G, and 49B to the highest luminance (max=1.0) of the fourth sub-pixel 49W is equal to the luminance (0.8 being lower than max in FIG. 6) lower than the highest luminance of the first, second, and third sub-pixels 49R, 49G, and 49B. This fact indicates that white at the highest luminance reproducible by the combination of the first, second, and third sub-pixels 49R, 49G, and 49B is higher in luminance than white at the highest luminance reproducible by the fourth sub-pixel 49W.

The luminance ratio between white at the highest luminance reproducible by the combination of the first, second, and third sub-pixels 49R, 49G, and 49B and white at the highest luminance reproducible by the fourth sub-pixel 49W is set in advance. In one example, the luminance ratio is set by using a ratio between an area of the combination of the first, second, and third sub-pixels 49R, 49G, and 49B and an area of the fourth sub-pixel 49W, which are assigned in the pixel 48. In another example, the luminance ratio is set by using differences in light transmittance between the color filters (for example, the first color filter, the second color filter, and the third color filter) provided on the respective sub-pixels 49.

When the sub-pixels 49 having the same color are arranged in the other direction (for example, the V-direction) of the row and column directions as illustrated in FIG. 2, the signal processor 20 assigns the second color components 72 or 82 to the first, second, and third sub-pixels 49R, 49G, and 49B. A single pixel 48 includes the fourth sub-pixel 49W assigned the first color component 71 or 81 and includes the first, second, and third sub-pixels 49R, 49G, and 49B assigned the second color components 72 or 82. This can be applied to both the case where the signal processing described with reference to FIG. 5 is performed and the case where the signal processing described with reference to FIG. 6 is performed.

As described above, according to the first embodiment, the signal processor 20 assigns, to one pixel 48 included in the image display panel 30, the color components assigned to two pieces of the pixel data Pix arranged adjacently in one direction (for example, the x-direction) of the row and column directions in the input signals IP. The pixel data Pix includes the red (R) sub-pixel data SPixR, the green (G) sub-pixel data SPixG, and the blue (B) sub-pixel data SPixB. The pixel 48 includes the red (R) first sub-pixel 49R, the green (G) second sub-pixel 49G, the blue (B) third sub-pixel 49B, and the white (W) fourth sub-pixel 49W. With this configuration, the image data with a predetermined resolution composed of a predetermined number of pieces of the pixel data Pix can be displayed with the pixels 48 the number of which is smaller than the predetermined number.

As exemplified by the description with reference to FIG. 5, the first color component 71 can be the white component included in one (for example, the pixel data Pix2) of the two pieces of pixel data Pix1 and Pix2. Thus, the white component can be assigned by more simplified processing.

As exemplified by the description with reference to FIG. 6, if white at the highest luminance reproducible by the combination of the first, second, and third sub-pixels 49R, 49G, and 49B is higher in luminance than white at the highest luminance reproducible by the fourth sub-pixel 49W, one pixel 48 can reproduce the two pieces of pixel data Pix1 and Pix2 by using, as the first color component 81, a part of the white component included in one (for example, the pixel data Pix2) of the two pieces of pixel data Pix1 and Pix2.

The sub-pixels 49 having the same color are arranged in either of the row and column directions (for example, the V-direction). Thus, the second color components 72 or 82 can be assigned to the first, second, and third sub-pixels 49R, 49G, and 49B included in a single pixel 48 that includes the fourth sub-pixel 49W assigned the first color component 71 or 81.

Second Embodiment

The following describes a second embodiment. In the description of the second embodiment, the same components as those of the first embodiment will be denoted by the same reference numerals, and the description thereof will not be repeated in some cases.

Figure 7:
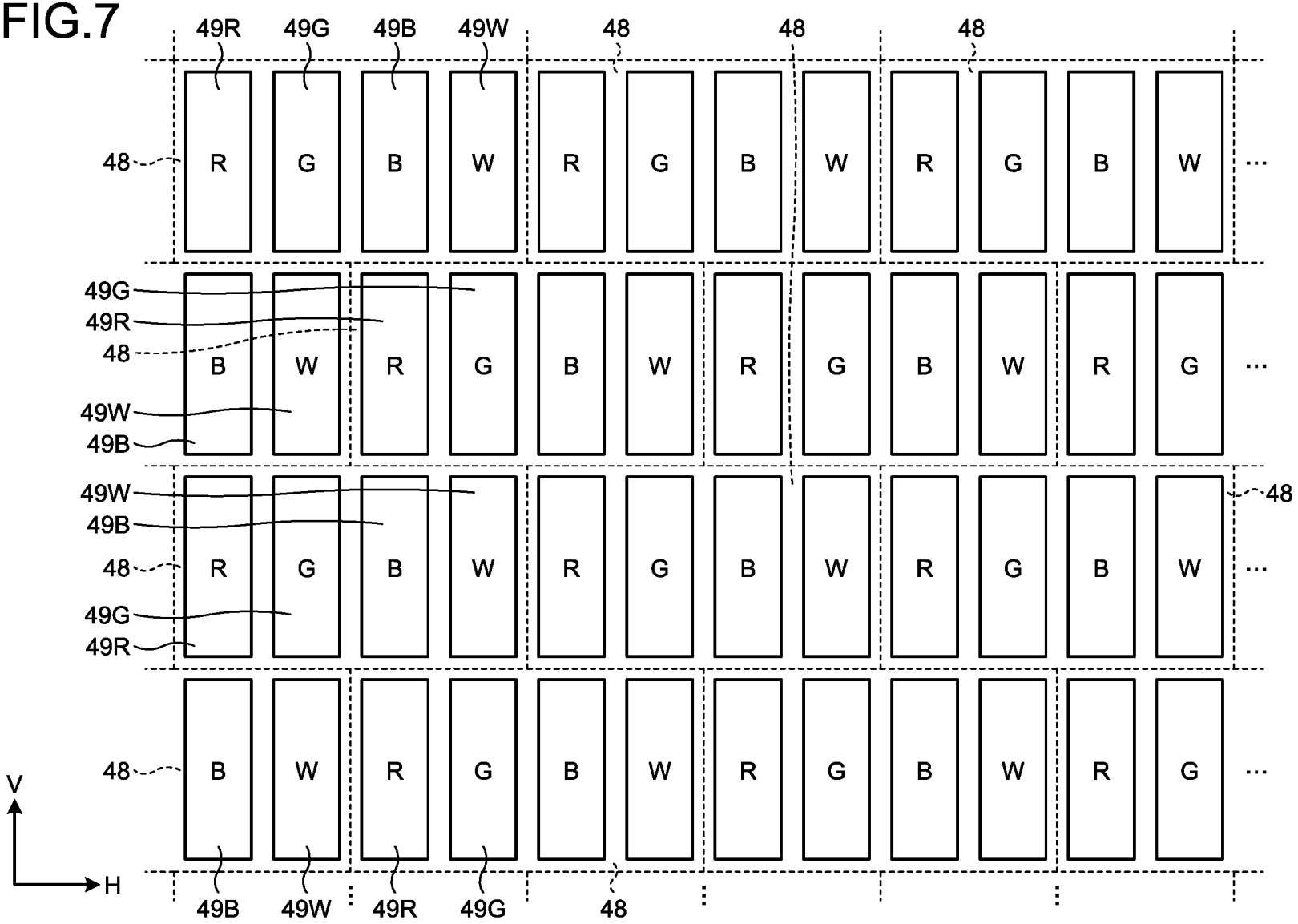
FIG. 7 is a schematic diagram illustrating an array of the pixels and the sub-pixels of the image display panel according to a second embodiment.

FIG. 7 is a schematic diagram illustrating an array of the pixels 48 and the sub-pixels 49 of the image display panel according to the second embodiment. In the second embodiment, the pixels 48 are arranged in a staggered manner on the image display panel 30. Specifically, as illustrated in FIG. 7, the sub-pixels 49 of two colors are alternately arranged along the V-direction. More specifically, a first sub-pixel column and a second sub-pixel column are alternately arranged in the H-direction. The first sub-pixel column is a column of the sub-pixels 49 in which the first sub-pixel 49R and the third sub-pixel 49B are alternately arranged along the V-direction, and the second sub-pixel column is a column of the sub-pixels 49 in which the second sub-pixel 49G and the fourth sub-pixel 49W are alternately arranged along the V-direction. In other words, the first sub-pixels 49R are arranged in a staggered manner; the second sub-pixels 49G, the third sub-pixels 49B, and the fourth sub-pixels 49W are also arranged in a staggered manner in the same way as the first sub-pixels 49R. In this way, in the second embodiment, the colors of the sub-pixels 49 are arranged in a staggered manner.

In the second embodiment, in the case of performing the signal processing described with reference to FIG. 5, the signal processor 20 may perform the processing such that a single pixel 48 includes the sub-pixel 49 assigned the first color component 71 or 81 and the sub-pixels 49 assigned the second color components 72 or 82 in the same way as in the first embodiment. Further, in the second embodiment, in some cases of performing the signal processing described with reference to FIG. 6, the signal processor 20 may preferably perform exception handling in which the sub-pixel 49 assigned the first color component 71 or 81 and the sub-pixels 49 assigned the second color components 72 or 82 are not limited to being included in one pixel 48.

Figure 8:
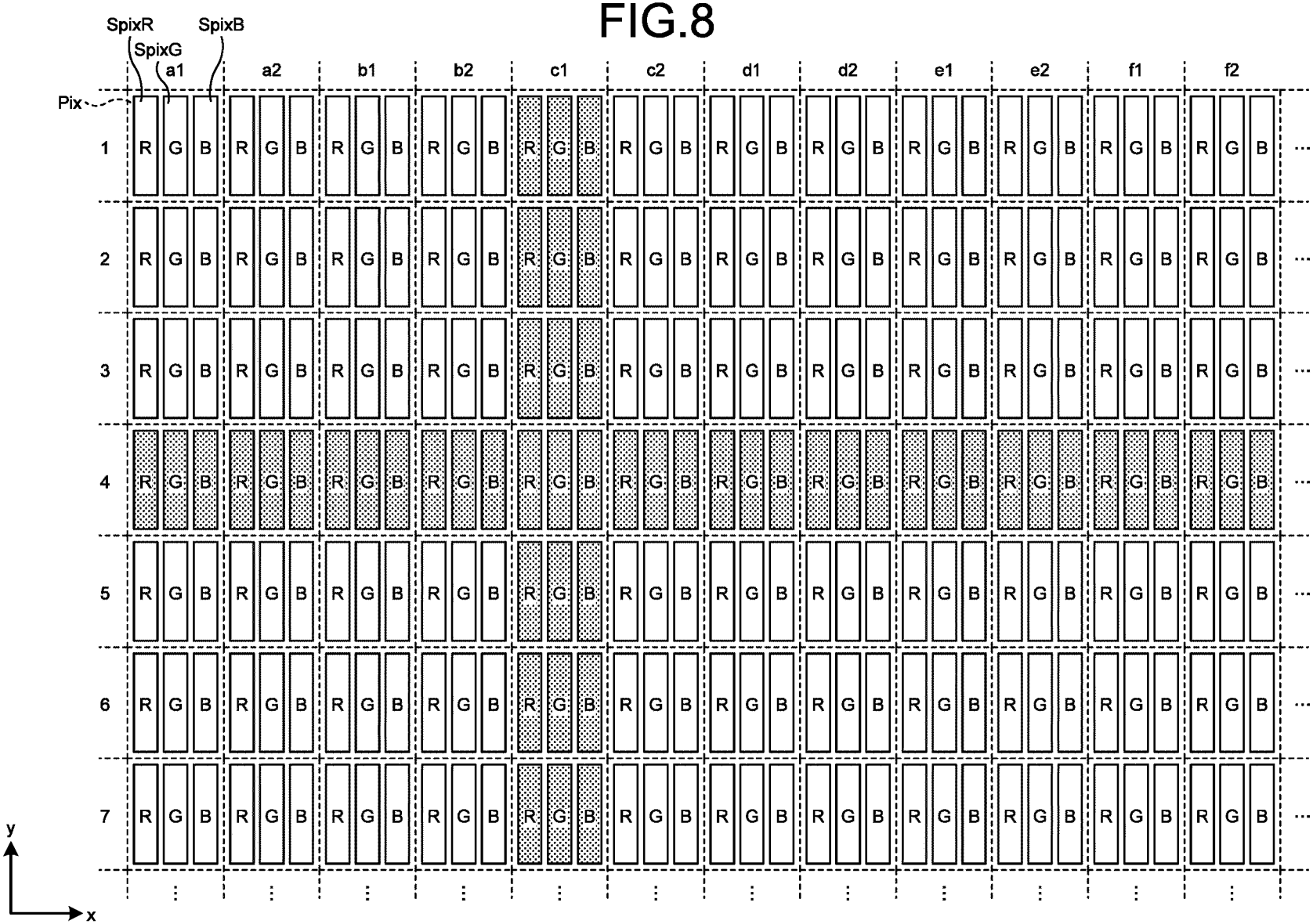
FIG. 8 is a schematic diagram illustrating an example of the image data based on the input signals.
Figure 9:
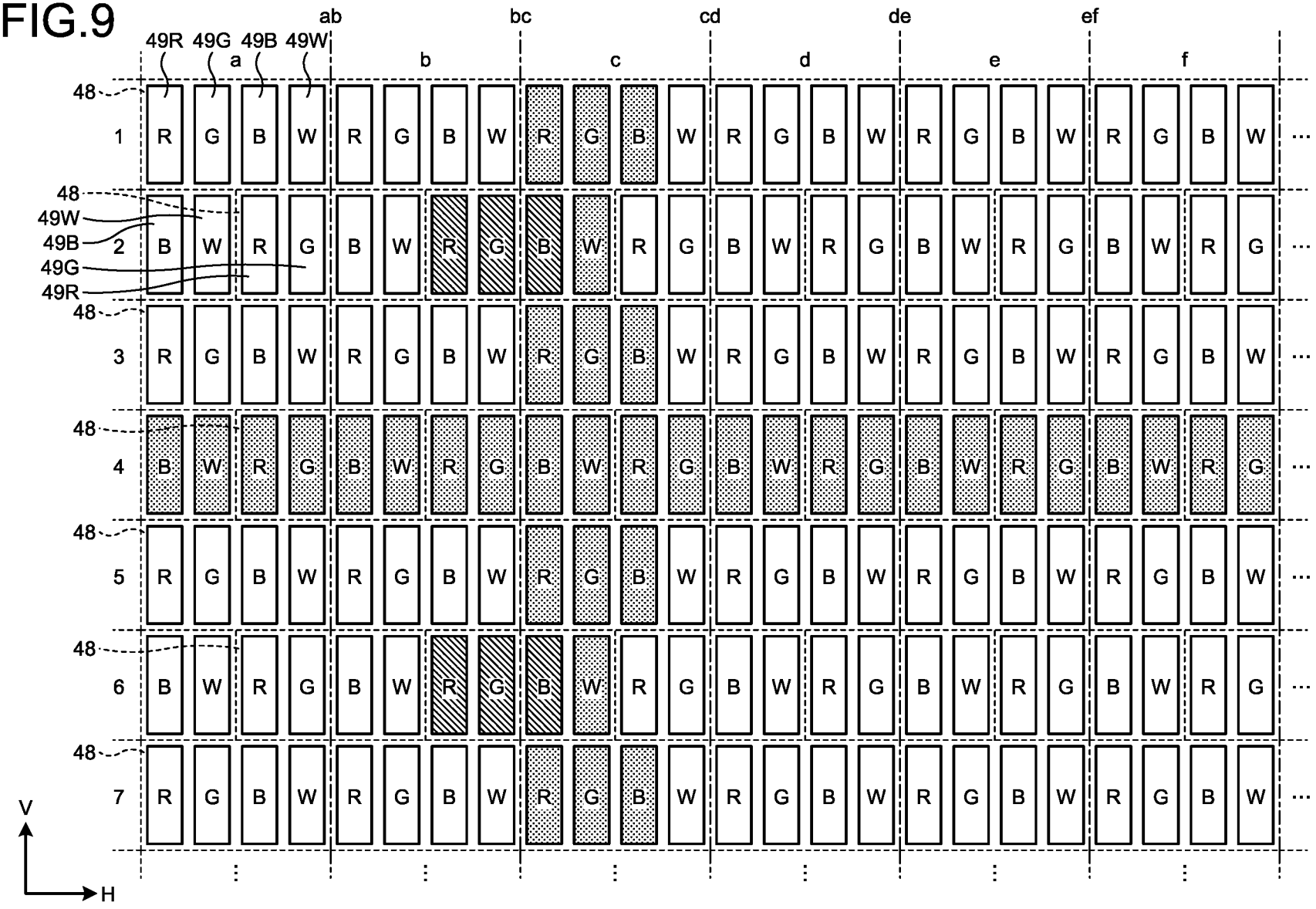
FIG. 9 is a schematic diagram illustrating a lighting pattern example when exception handling is not applied.

FIG. 8 is a schematic diagram illustrating an example of the image data based on the input signals IP. FIG. 9 is a schematic diagram illustrating a lighting pattern example when the exception handling is not applied. In FIG. 8, the arrangement of the pixel data Pix in the x-direction is expressed by coordinates a1, a2, b1, b2, c1, c2, d1, d2, e1, e2, f1, f2, . . . . In FIG. 8, the arrangement of the pixel data Pix in the y-direction is expressed by coordinates 1, 2, 3, 4, 5, 6, 7, . . . . In FIG. 9, the arrangement of the pixels 48 in the H-direction is expressed by coordinates a, b, c, d, e, f, . . . . In FIG. 9, the arrangement of the pixels 48 in the V-direction is expressed by coordinates 1, 2, 3, 4, 5, 6, 7, . . . . The scanning for driving the pixels 48 in the display unit 25 is performed from coordinate 1 toward coordinate 7 in the V-direction in FIG. 9 and in FIG. 13 to be explained later.

The following describes, using the coordinates in FIGS. 8 and 9, relations between the input signals IP and the output signals OP when the sub-pixel 49 assigned the first color component 71 or 81 and the sub-pixels 49 assigned the second color components 72 or 82 are limited to being included in one pixel 48. For example, color components of the input signals IP for the pixel data Pix having the x-direction coordinate of a1 and the y-direction coordinate of m (m is an odd natural number) and the pixel data Pix having the x-direction coordinate of a2 and the y-direction coordinate of m are assigned to the pixel 48 having the H-direction coordinates of a1 and a2 and the V-direction coordinate of m in the output signal OP. This relation between the input signals IP and the output signal OP is represented by (a1+a2, m)→(a, m). In the same way, the other relations therebetween can be represented by (b1+b2, m)→(b, m), (c1+c2, m)→(c, m), (d1+d2, m)→(d, m), (e1+e2, m)→(e, m), and (f1+f2, m)→(f, m). Color components of the input signals IP for the pixel data Pix having the x-direction coordinate of a2 and the y-direction coordinate of n (n is an even natural number) and the pixel data Pix having the x-direction coordinate of b1 and the y-direction coordinate of n are assigned to the pixel 48, through the center in the H-direction of which a long-dashed short-dashed line ab passes and the V-direction coordinate of which is n in the output signal OP. This relation between the input signals IP and the output signal OP is represented by (a2+b1, n)→(ab, n). In the same way, the other relations therebetween can be represented by (b2+c1, n)→(bc, n), (c2+d1, n)→(cd, n), (d2+e1, n)→(de, n), and (e2+f1, n)→(ef, n).

The image data illustrated in FIG. 8 has a column of the white pixel data Pix along the y-direction at the x-direction coordinate of c1 and a row of the white pixel data Pix along the x-direction at the y-direction coordinate of 4. The pixel data Pix other than the pixel data Pix included in the row and the column of the white pixel data Pix is black. In FIG. 8, the sub-pixel data SPixR, the sub-pixel data SPixG, and the sub-pixel data SPixB constituting the white pixel data Pix have a dot pattern applied thereto, and the sub-pixel data SPixR, the sub-pixel data SPixG, and the sub-pixel data SPixB constituting the black pixel data Pix have no pattern applied thereto. The same applies to FIGS. 10, 11, and 12 to be explained later.

When, in the second embodiment, the signal processing described with reference to FIG. 6 is applied to the input signals IP corresponding to the image data illustrated in FIG. 8, and the sub-pixels 49 assigned the first color component 71 or 81 and the sub-pixels 49 assigned the second color components 72 or 82 are limited to being included in one pixel 48, an output illustrated in FIG. 9 is obtained. Specifically, a conversion from the input signals IP to the output signal OP represented by (b2+c1, 2)→(bc, 2) causes the first sub-pixel 49R and the second sub-pixel 49G included in the coordinates (b, 2) to be lit. In contrast, the sub-pixels 49 included in the pixels 48 having the coordinates (b, 1) and the coordinates (b, 3) are not lit. More specifically, since the coordinates (c1, 1) in FIG. 8 correspond to an RGB position of (c, 1) in FIG. 9, white is displayed by only the combination of the first, second, and third sub-pixels 49R, 49G, and 49B in FIG. 9. The coordinates (c1, 2) in FIG. 8 correspond to the fourth sub-pixel 49W at (c, 2) in FIG. 9. Consequently, in a single pixel 48, while the fourth sub-pixel 49W displays white, the first, second, and third sub-pixels 49R, 49G, and 49B are used so as to make up for the insufficient luminance of the white. As a result, a lighting pattern occurs that protrudes from the coordinate c to the coordinate b at a position of the coordinates (b, 2) in the column of the sub-pixels 49 with the coordinates (b, 1), (b, 2), and (b, 3) arranged consecutively in the V-direction. In the same way, a conversion from the input signals IP to the output signal OP represented by (b2+c1, 6)→(bc, 6) causes the first sub-pixel 49R and the second sub-pixel 49G included in the coordinates (b, 6) to be lit. In contrast, the sub-pixels 49 included in the pixels 48 having the coordinates (b, 5) and the coordinates (b, 7) are not lit. As a result, a lighting pattern occurs that protrudes from the coordinate c to the coordinate b at a position of the coordinates (b, 6) in the column of the sub-pixels 49 with the coordinates (b, 5), (b, 6), and (b, 7) arranged consecutively in the V-direction. In other words, an image having the column of the white pixel data Pix along the y-direction at the coordinate of c1 in the input signals IP is changed to an image having the lighting pattern that protrudes from the coordinate c to the coordinate b at the coordinates (b, 2) and the coordinates (b, 6) in the output signals OP.

As described with reference to FIG. 6, the lighting pattern illustrated in FIG. 9 occurs when the pixel data Pix in the input signals IP corresponds to the fourth sub-pixel 49W of the image display panel 30. In other words, the lighting pattern illustrated in FIG. 9 occurs when white at the highest luminance reproducible by the combination of the first, second, and third sub-pixels 49R, 49G, and 49B is higher in luminance than white at the highest luminance reproducible by the fourth sub-pixel 49W, or, in still other words, when the luminance of white is supplemented by using the first, second, and third sub-pixels 49R, 49G, and 49B. In this case, when the exception is not provided for the limitation in which the color components are assigned within each of the pixels 48, an output corresponding to the output signals OP illustrated in FIG. 9 is generated, in some cases. Therefore, in the second embodiment, the exception handling is provided for the destination of assignment of the second color components, and thereby, the lighting pattern protruding at the coordinates (b, 2) and the coordinates (b, 6) in FIG. 9 can be restrained from occurring. The following describes the exception handling with reference to FIGS. 10 to 12.

Figure 10:
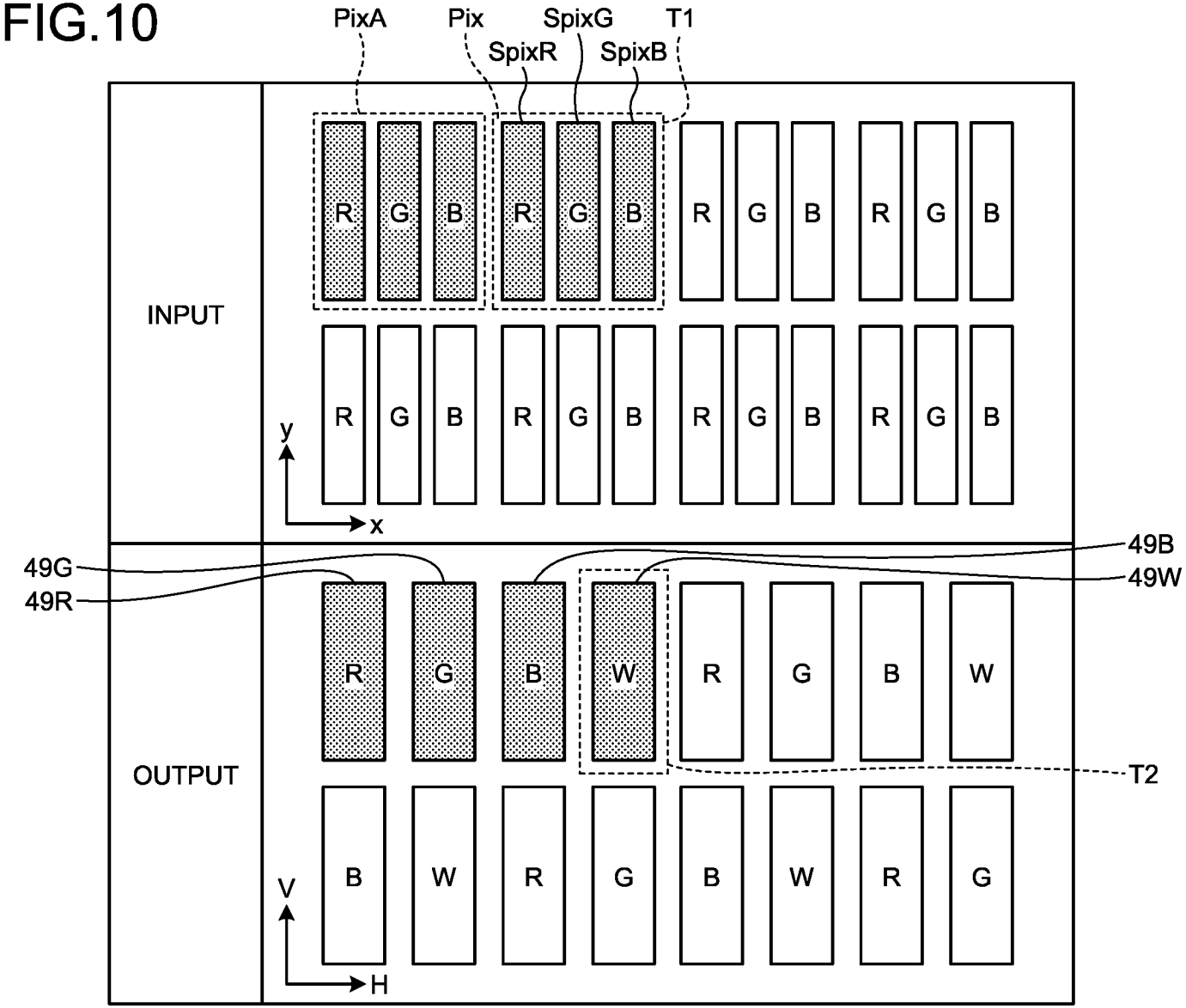
FIG. 10 is an explanatory diagram illustrating a pattern of the exception handling.
Figure 11:
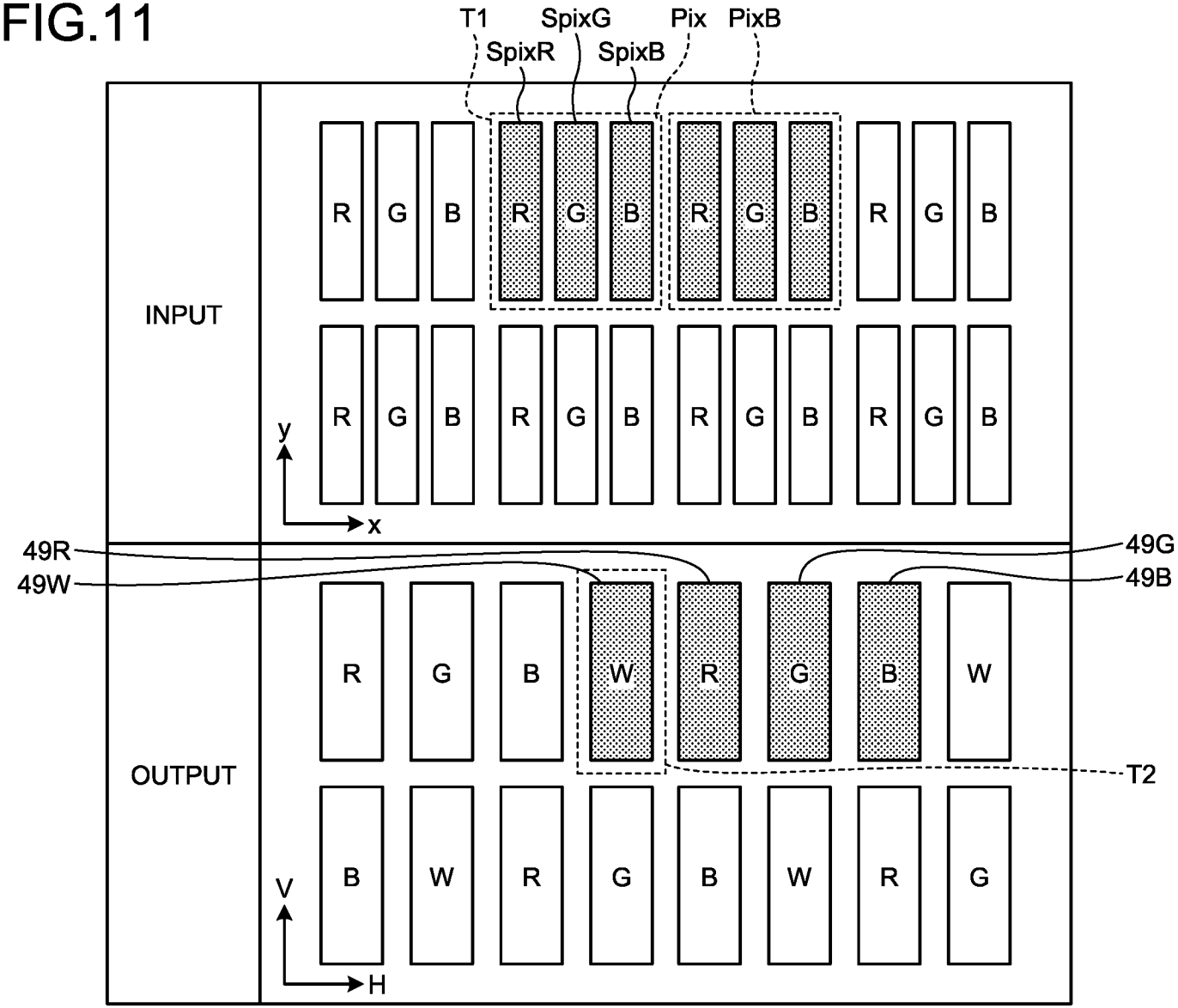
FIG. 11 is an explanatory diagram illustrating another pattern of the exception handling.
Figure 12:
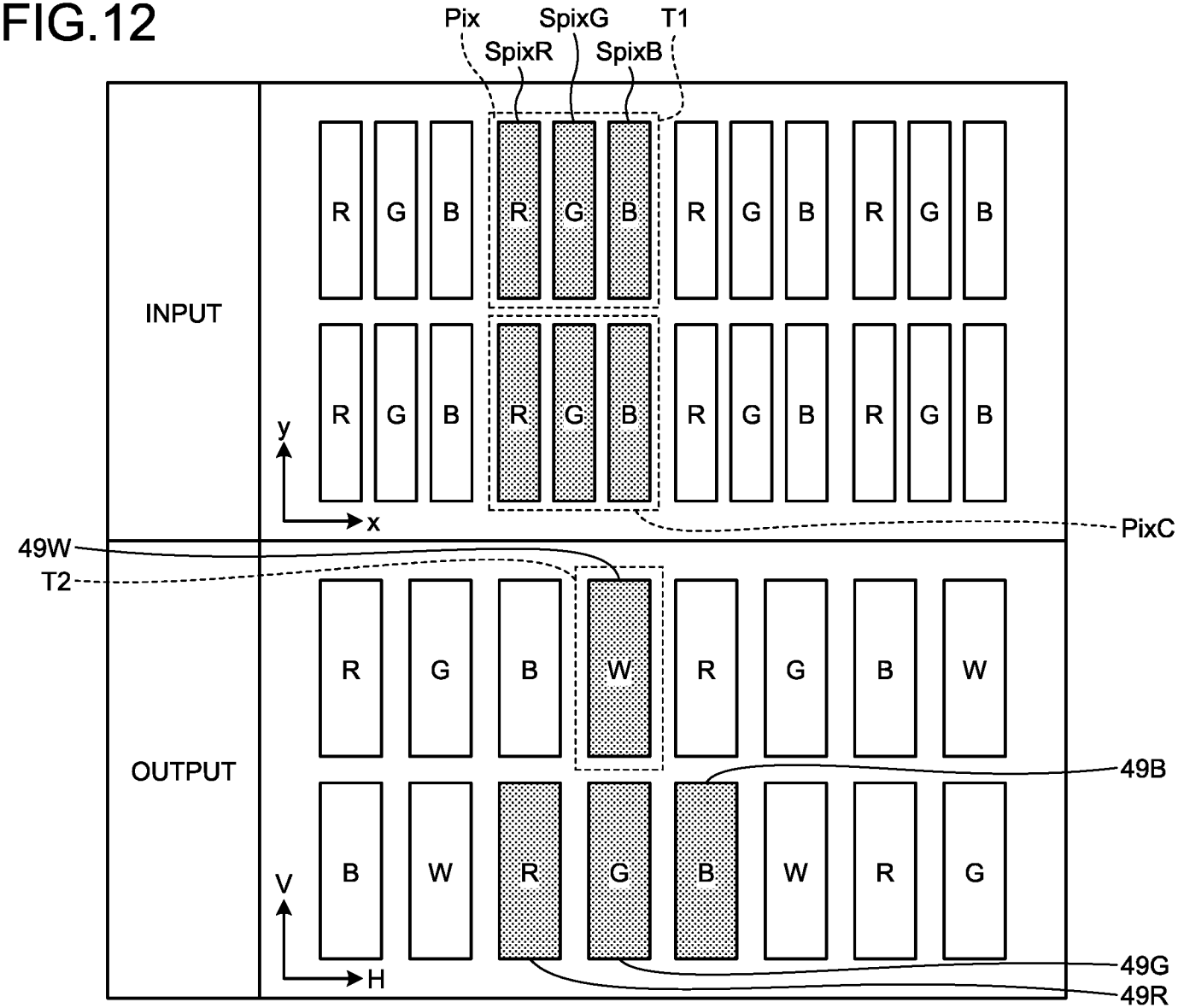
FIG. 12 is an explanatory diagram illustrating still another pattern of the exception handling.

FIGS. 10, 11, and 12 are each an explanatory diagram illustrating a pattern of the exception handling. In FIGS. 10, 11, and 12, an input target T1 denotes one of the two pieces of the pixel data Pix in the input signals that serves as a basis for the first color component 81, and an output target T2 denotes the fourth sub-pixel 49W that serves as the target of the output signals corresponding to the input target T1. In FIGS. 10, 11, and 12, the fourth sub-pixel 49W assigned with the first color component 81 and the first, second, and third sub-pixels 49R, 49G, and 49B assigned with the second color component 82 have a dot pattern applied thereto.

FIG. 10 illustrates the pixel data Pix serving as the input target T1 and pixel data PixA next to the pixel data Pix in the x-direction. In this case, when the input target T1 and the pixel data PixA are white, the signal processor 20 assigns the remaining components 82*a* to the combination of the first, second, and third sub-pixels 49R, 49G, and 49B that are located corresponding to the pixel data PixA with respect to the output target T2. As a result, the fourth sub-pixel 49W serving as the output target T2 is lit in accordance with the first color component 81. In addition, the first, second, and third sub-pixels 49R, 49G, and 49B located corresponding to the pixel data PixA are lit in accordance with the second color components 82.

FIG. 11 illustrates the pixel data Pix serving as the input target T1 and pixel data PixB next to the pixel data Pix in the x-direction. In this case, when the input target T1 and the pixel data PixB are white, the signal processor 20 assigns the remaining component 82*a* to the combination of the first, second, and third sub-pixels 49R, 49G, and 49B that are located corresponding to the pixel data PixB with respect to the output target T2. As a result, the fourth sub-pixel 49W serving as the output target T2 is lit in accordance with the first color component 81. In addition, the first, second, and third sub-pixels 49R, 49G, and 49B located corresponding to the pixel data PixB are lit in accordance with the second color component 82. The pixel data PixA illustrated in FIG. 10 is located opposite to the pixel data PixB illustrated in FIG. 11 in the x-direction with the input target T1 interposed therebetween. Thus, the first, second, and third sub-pixels 49R, 49G, and 49B that are located corresponding to the pixel data PixA, are located opposite, in the H-direction, to the first, second, and third sub-pixels 49R, 49G, and 49B that are located corresponding to the pixel data PixB, with the output target T2 interposed therebetween.

As described with reference to FIGS. 10 and 11, when the signal processor 20 of the second embodiment receives the input signals IP including pixel data Pix (for example, the input target T1) and another pixel data Pix (for example, the pixel data PixA or the pixel data PixB) next to the input target T1 in one direction (for example, the x-direction) for lighting corresponding pixels, the signal processor 20 assigns the color components (remaining components 82*a*) not included in the first color component 81 among the color components included in the input target T1 to the first, second, and third sub-pixels 49R, 49G, and 49B located corresponding to the other pixel data Pix.

FIG. 12 illustrates the pixel data Pix serving as the input target T1 and pixel data PixC next to the pixel data Pix in the y-direction and located on a forward side of the pixel date Pix in a direction of the scanning (scanning direction) of the scanning circuit 42. In this case, when the input target T1 and the pixel data PixC are white, the remaining components 82*a* of the pixel data PixC are assigned to the first, second, and third sub-pixels 49R, 49G, and 49B adjacent to the pixel data PixC also on the image display panel 30 in the V-direction. In other words, the signal processor 20 assigns the remaining components 82*a* to the combination of the first, second, and third sub-pixels 49R, 49G, and 49B that are located corresponding to the pixel data PixC with respect to the output target T2. As a result, the fourth sub-pixel 49W serving as the output target T2 is lit in accordance with the first color component 81. In addition, the first, second, and third sub-pixels 49R, 49G, and 49B located corresponding to the pixel data PixC are lit in accordance with the second color component 82.

As described with reference to FIG. 12, when the signal processor 20 receives the input signals IP including pixel data Pix (for example, the input target T1) for lighting a corresponding pixel and another pixel data Pix next to the input target T1 in one direction (for example, the x-direction) for not lighting a corresponding pixel, the signal processor 20 assigns the color components (remaining components 82*a*) not included in the first color component 81 among the color components included in the input target T1 to the first, second, and third sub-pixels 49R, 49G, and 49B aligned, in the scanning direction, with respect to the fourth sub-pixel 49W (output target T2) assigned the first color component 81. As described with reference to FIGS. 10, 11, and 12, the exception handling provides an exception for one form of a set of sub-pixels, that is, the pixel 48. The signal processor 20 determines the first, second, and third sub-pixels 49R, 49G, and 49B that form a set with the fourth sub-pixel 49W serving as the output target T2 based on the relation between the input target T1 and the output target T2 and on whether sub-pixels corresponding to the pixel data Pix adjacent to the input target T1 is lit.

If any sub-pixels corresponding to the pixel data Pix adjacent, in the x-direction and the y-direction, to the pixel data Pix serving as the input target T1 are not lit, the remaining components 82*a* may be assigned to the combination of the first, second, and third sub-pixels 49R, 49G, and 49B aligned with respect to the output target T2 in the scanning direction, in the same way as in the example illustrated in FIG. 12. In this case, alternatively, the remaining components 82*a* may be discarded. In other words, the fourth sub-pixel 49W serving as the output target T2 may be lit only in accordance with the first color component 81.

Figure 13:
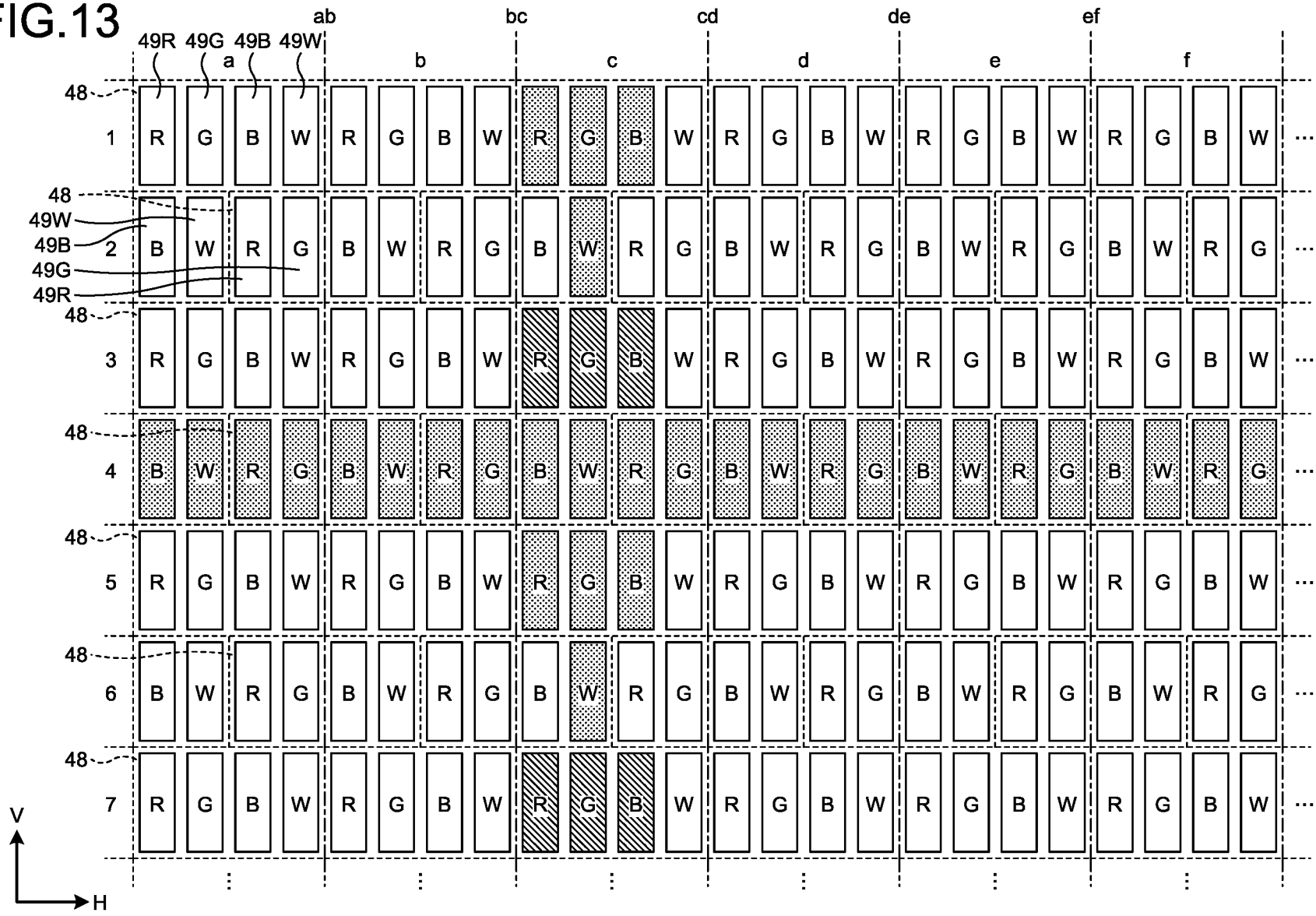
FIG. 13 is a schematic diagram illustrating a lighting pattern example when the exception handling is applied.

FIG. 13 is a schematic diagram illustrating a lighting pattern example when the exception handling is applied. The coordinates in FIG. 13 are the same as those in FIG. 9. In the example illustrated in FIG. 13, the exception handling described with reference to FIG. 12 is applied to the conversion from the input signals IP to the output signals OP represented by (b2+c1, 2)→(bc, 2). In other words, the pixel data Pix at (c1, 2) is handled as the input target T1 and the pixel data Pix at (c1, 3) is handled as the pixel data PixC, and thereby, the remaining components 82*a* are assigned to the first, second, and third sub-pixels 49R, 49G, and 49B included in the pixel 48 at (c, 3) located in the scanning direction with respect to the sub-pixels 49 included in the pixel 48 at (bc, 2). As a result, the first, second, and third sub-pixels 49R, 49G, and 49B included in the pixel 48 at (bc, 2) are not lit. Thus, the lighting pattern protruding from the coordinate c to the coordinate b in the position of the coordinates (b, 2) in FIG. 9 is restrained from occurring. In the same way, the pixel data Pix at (c1, 6) is handled as the input target T1 and the pixel data Pix at (c1, 7) is handled as the pixel data PixC, and thereby, the remaining components 82*a* are assigned to the first, second, and third sub-pixels 49R, 49G, and 49B included in the pixel 48 at (c, 7) located in the scanning direction with respect to the sub-pixels 49 included in the pixel 48 at (bc, 6). As a result, the first, second, and third sub-pixels 49R, 49G, and 49B included in the pixel 48 at (bc, 6) are not lit. Thus, the lighting pattern protruding from the coordinate c to the coordinate b in the position of the coordinates (b, 6) in FIG. 9 is restrained from occurring. In FIGS. 9 and 13, "dense hatching illustrated by oblique lines" is applied to the first, second, and third sub-pixels 49R, 49G, and 49B assigned the remaining components 82*a* generated based on the pixels at (c, 2) and (c, 6).

As described above, according to the second embodiment, the image more faithful to the input signals IP can be displayed with image data even if white at the highest luminance reproducible by the combination of the first, second, and third sub-pixels 49R, 49G, and 49B is higher in luminance than white at the highest luminance reproducible by the fourth sub-pixel 49W, even if the first color component 81 is a part of the white component included in one of two pieces of the pixel data Pix arranged in one direction (for example, the x-direction) in the input signals IP that is closer to the arrangement position in one direction (for example, the H-direction) of the fourth sub-pixel 49W in one pixel 48, and even if the colors of the sub-pixels 49 are arranged in a staggered manner.

The signal processor 20 of the second embodiment performs the signal processing as described with reference to FIGS. 10 and 11, when the signal processor 20 receives the input signals IP including the input target T1 and the pixel data PixA (or pixel data PixB), each of which is pixel data for lighting a corresponding pixel. This, however, is only an example, and the signal processor 20 is not limited thereto. That is, the signal processor 20, for example, is capable of performing signal processing as follows: When the signal processor 20 receives the input signals IP including pixel data Pix-1 and pixel data Pix-2 next to the pixel data Pix-1 in one direction each of which is pixel data for causing a corresponding pixel to be relatively bright, the signal processor 20 assigns the color components not included in the first color component 81 among the color components included in the pixel data Pix-1 to the first, second, and third sub-pixels located corresponding to the pixel data Pix-2.

The signal processor 20 of the second embodiment performs the signal processing as described with reference to FIG. 12, when the signal processor 20 receives the input signals IP including the input target T1 for lighting a corresponding pixel and the pixel data PixC not for lighting a corresponding pixel. This, however, is only an example, and the signal processor 20 is not limited thereto. That is, the signal processor 20, for example, is capable of performing signal processing as follows: When the signal processor 20 receives the input signals IP including pixel data Pix-3 for causing a corresponding pixel to be relatively bright and pixel data Pix-4 next to the pixel data Pix-3 in one direction for causing a corresponding pixel to be relatively dark, the signal processor 20 assigns the color components not included in the first color component among the color components included in the pixel data Pix-3 to the first, second, and third sub-pixels aligned, in the scanning direction (a direction intersecting the one direction), with the fourth sub-pixel assigned the first color component.

Modification

Figure 14:
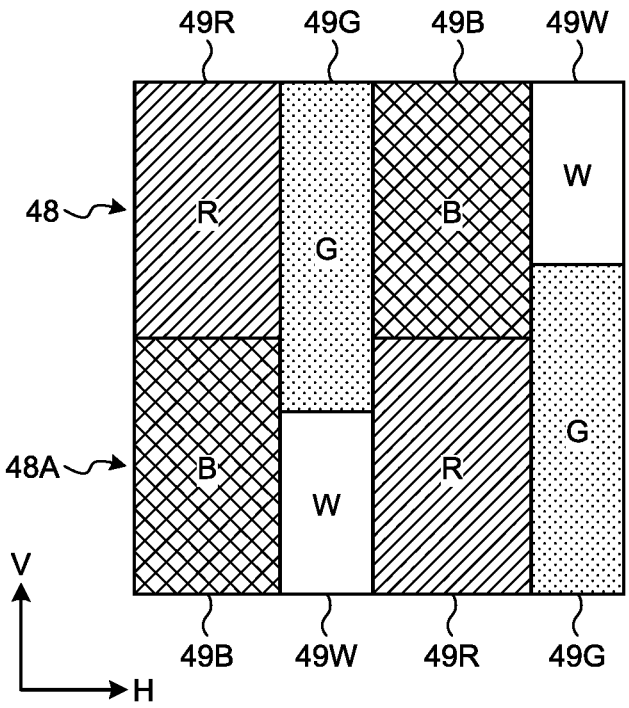
FIG. 14 is a schematic diagram illustrating an example of shapes and arrangement of the sub-pixels in a modification.

FIG. 14 is a schematic diagram illustrating an example of shapes and arrangement of the sub-pixels 49 in a modification. The sub-pixels 49 included in the pixel 48 described with reference to FIG. 7 and other figures in the second embodiment have the same shape and the same size regardless of the colors thereof. However, the sub-pixels 49 may differ from one another in at least either one of the shape or the size according to the color. For example, as illustrated in FIG. 14, the first sub-pixel 49R and the third sub-pixel 49B may have a different width in the H-direction from that of the second sub-pixel 49G and the fourth sub-pixel 49W. The second sub-pixel 49G may have a different width in the V-direction from that of the fourth sub-pixel 49W. In FIG. 14, the width in the H-direction of the first sub-pixel 49R and the third sub-pixel 49B is greater than that of the second sub-pixel 49G and the fourth sub-pixel 49W; the width in the V-direction of the second sub-pixel 49G is greater than those of the first sub-pixel 49R, the third sub-pixel 49B, and the fourth sub-pixel 49W; and the width in the V-direction of the fourth sub-pixel 49W is less than those of the first sub-pixel 49R and the second sub-pixel 49G. The shape and the size for each color of the sub-pixels 49 illustrated in FIG. 14 are merely examples, and are not limited thereto.

FIG. 14 illustrates the example in which the pixel 48 and a pixel 48A are arranged in the V-direction. The pixel 48 includes the first sub-pixel 49R, the second sub-pixel 49G, the third sub-pixel 49B, and the fourth sub-pixel 49W arranged in this order from one side toward the other side in the H-direction. The pixel 48A includes the third sub-pixel 49B, the fourth sub-pixel 49W, the first sub-pixel 49R, and the second sub-pixel 49G arranged in this order from one side toward the other side in the H-direction. The sub-pixels included in the pixel 48A may constitute a part of two pixels 48 arranged in a staggered manner with respect to a pixel 48, as described in the second embodiment.

The relation between the row direction (H-direction) and the column direction (V-direction) in the above description may be reversed. In this case, the relation between the x-direction and the y-direction is also reversed. Although the above description has exemplified the case where the display device 10 is a transmissive color liquid crystal display device, the display device 10 is not limited thereto. Other application examples of the display device include any type of flat-panel image display devices, including light-emitting display devices such as transflective or reflective liquid crystal display devices, display devices using organic electroluminescence (EL), and the like, and electronic paper display devices having, for example, electrophoretic elements. The present invention can obviously be applied to display devices of small, medium, and large sizes without particular limitation.

Other operational advantages accruing from the aspects described in the embodiments that are obvious from the description herein or that are appropriately conceivable by those skilled in the art will naturally be understood as accruing from the present invention.

What is claimed is:

1. A display device comprising:

a display unit in which a plurality of sub-pixels are arranged in a matrix along row and column directions; and a signal processor configured to output output signals for causing the display unit to display an image based on input signals for the image in which pixel data including three colors of red, green, and blue is arranged in a matrix, wherein the sub-pixels comprise a first sub-pixel for red, a second sub-pixel for green, a third sub-pixel for blue, and a fourth sub-pixel for white, wherein either the first sub-pixel or the third sub-pixel is interposed between the second sub-pixel and the fourth sub-pixel arranged in one direction of the row direction and the column direction, wherein the signal processor is configured to output the output signals to assign, to a set of the sub-pixels included in the display unit, color components assigned to two pieces of the pixel data arranged in the one direction in the input signals, wherein the set of the sub-pixels is made up of the first sub-pixel, the second sub-pixel, the third sub-pixel, and the fourth sub-pixel arranged along the row direction, and wherein the signal processor is configured to assign a first color component to the fourth sub-pixel and second color components to the first sub-pixel, the second sub-pixel, and the third sub-pixel, the first color component being a part or the whole of a white component included in one piece of the pixel data among the color components included in the two pieces of the pixel data, the second color components being components other than the first color component of the color components included in the two pieces of the pixel data, wherein scanning for driving the sub-pixels in the display unit is performed along the column direction, wherein white at the highest luminance reproducible by a combination of the first sub-pixel, the second sub-pixel, and the third sub-pixel is higher in luminance than white at the highest luminance reproducible by the fourth sub-pixel, wherein the first color component is a part of white component included in one of the two pieces of the pixel data arranged in the row direction in the input signals, the one piece of the pixel data being closer to an arrangement position in the row direction of the fourth sub-pixel in the set of the sub-pixels, wherein the colors of the sub-pixels are arranged in a staggered manner, wherein the signal processor is configured to, when the signal processor receives the input signals including the one piece of the pixel data and another piece of the pixel data next to the one piece of the pixel data in the row direction each piece of which is pixel data for causing a corresponding pixel to be relatively bright, assign color components not included in the first color component among the color components included in the one piece of the pixel data to the first sub-pixel, the second sub-pixel, and the third sub-pixel located corresponding to the other piece of the pixel data, and wherein the signal processor is configured to, when the signal processor receives the input signals including the one piece of the pixel data for causing a corresponding pixel to be relatively bright and the other piece of the pixel data for causing a corresponding pixel to be relatively dark, assign the color components not included in the first color component among the color components included in the one piece of the pixel data to the first sub-pixel, the second sub-pixel, and the third sub-pixel aligned, in a direction of the scanning, with the fourth sub-pixel assigned the first color component.

2. A display device comprising:

a display unit in which a plurality of sub-pixels are arranged in a matrix along a first direction and a second direction crossing the first direction; and a signal processor configured to output output signals for causing the display unit to display an image based on input signals for the image in which pixel data including three colors of red, green, and blue is arranged in a matrix, wherein the sub-pixels comprise a first sub-pixel for red, a second sub-pixel for green, a third sub-pixel for blue, and a fourth sub-pixel for white, wherein either the first sub-pixel or the third sub-pixel is interposed between the second sub-pixel and the fourth sub-pixel arranged in the first direction, wherein the sub-pixels of each color are arranged in a staggered manner, wherein the signal processor is configured to output the output signals to assign, to a set of the sub-pixels included in the display unit, color components assigned to two pieces of the pixel data arranged in the first direction in the input signals, wherein the set of the sub-pixels is made up of the first sub-pixel, the second sub-pixel, the third sub-pixel, and the fourth sub-pixel, wherein the signal processor is configured to assign a first color component to the fourth sub-pixel and second color components to the first sub-pixel, the second sub-pixel, and the third sub-pixel, the first color component being a part or the whole of a white component included in one piece of the pixel data among the color components included in the two pieces of the pixel data, the second color components being components other than the first color component of the color components included in the two pieces of the pixel data, and wherein when a linear image extending along the second direction is displayed in the display unit, the signal processor assigns the second color component to a set of the first to third sub-pixels adjacent, in the second direction, to the fourth sub-pixel to which the first color component is assigned.

3. The display device according to claim 2, wherein when a linear image extending along the first direction is displayed in the display unit, the signal processor assigns the second color component to a set of the first to third sub-pixels adjacent, in the first direction, to the fourth sub-pixel to which the first color component is assigned.

4. The display device according to claim 2, wherein the first color component is a white component included in one of the two pieces of the pixel data.

5. The display device according to claim 2, wherein white at the highest luminance reproducible by a combination of the first sub-pixel, the second sub-pixel, and the third sub-pixel is higher in luminance than white at the highest luminance reproducible by the fourth sub-pixel, and wherein the first color component is a part of the white component included in one of the two pieces of the pixel data.

6. The display device according to claim 2, wherein the set of the sub-pixels is made up of the first sub-pixel, the second sub-pixel, the third sub-pixel, and the fourth sub-pixel arranged along the first direction.

* * * * *